US009042783B2

(12) United States Patent
Yamamoto

(10) Patent No.: US 9,042,783 B2
(45) Date of Patent: May 26, 2015

(54) IMAGE FORMING APPARATUS

(71) Applicant: Tomoya Yamamoto, Nagoya (JP)

(72) Inventor: Tomoya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 42 days.

(21) Appl. No.: 13/833,550

(22) Filed: Mar. 15, 2013

(65) Prior Publication Data

US 2013/0259529 A1 Oct. 3, 2013

(30) Foreign Application Priority Data

Mar. 28, 2012 (JP) ..... 2012-074614

(51) Int. Cl.
*G03G 15/00* (2006.01)
*G03G 21/16* (2006.01)

(52) U.S. Cl.
CPC ..... *G03G 15/757* (2013.01); *G03G 21/1633* (2013.01); *G03G 21/1647* (2013.01)

(58) Field of Classification Search
CPC ..... G03G 15/757; G03G 2215/0119; G03G 21/16; G03G 2221/1681
USPC ..... 399/107, 125, 167
See application file for complete search history.

(56) References Cited

U.S. PATENT DOCUMENTS 5,317,934 A * 6/1994 Zannis ..... 74/40
6,415,118 B1 7/2002 Setoriyama et al.
7,215,905 B2 5/2007 Kamimura
7,274,894 B2 9/2007 Sato et al.
7,395,008 B2 7/2008 Sato et al.
7,415,223 B2 8/2008 Sato et al.
7,486,909 B2 2/2009 Sato et al.
7,489,889 B2 2/2009 Sato et al.
7,697,869 B2 4/2010 Okimura et al.
2004/0165910 A1 8/2004 Sato et al.
2004/0175203 A1 9/2004 Kamimura (Continued)

FOREIGN PATENT DOCUMENTS

CN 1525258 A 9/2004
CN 1936722 A 3/2007

(Continued)

OTHER PUBLICATIONS

Mar. 4, 2015—(CN) Notificaiton of the First Office Action—App 201310102071.8.

*Primary Examiner* — Roy Y Yi
(74) *Attorney, Agent, or Firm* — Banner & Witcoff, Ltd.

(57) ABSTRACT

Provided is an image forming apparatus provided with an image forming unit. The image forming apparatus includes a movable member configured to be displaced relative to an apparatus main body; a cover configured to be displaced between a position where an opening portion provided on the apparatus main body is opened and a position where the opening portion is closed; a link that displaces the movable member in conjunction with the cover; a driving pulley and a driven pulley; and an endless belt that is looped around and stretched between the driving pulley and the driven pulley and transmits a driving force from the driving pulley to the driven pulley. The belt overlaps with the link in a direction parallel to a rotational axis of the driving pulley.

12 Claims, 14 Drawing Sheets

(56) References Cited

U.S. PATENT DOCUMENTS

| | | | | |
|---|---|---|---|---|
| 2005/0158078 | A1* | 7/2005 | Nomura et al. | 399/167 |
| 2006/0153589 | A1 | 7/2006 | Sato et al. | |
| 2007/0065182 | A1* | 3/2007 | Okimura et al. | 399/258 |
| 2008/0019731 | A1 | 1/2008 | Sato et al. | |
| 2008/0019732 | A1 | 1/2008 | Sato et al. | |
| 2008/0232852 | A1 | 9/2008 | Sato et al. | |
| 2010/0003051 | A1* | 1/2010 | Sekina et al. | 399/121 |

FOREIGN PATENT DOCUMENTS

| | | | |
|---|---|---|---|
| JP | 10-039715 | A | 2/1998 |
| JP | 2000-227696 | A | 8/2000 |
| JP | 2001-106384 | A | 4/2001 |
| JP | 2004271900 | A | 9/2004 |
| JP | 2005165205 | A | 6/2005 |
| JP | 2007-264523 | A | 10/2007 |

* cited by examiner

ENLARGED PART A

IMAGE FORMING APPARATUS

CROSS-REFERENCE TO RELATED APPLICATIONS

This application claims the benefit of Japanese Patent Application No. 2012-074614 filed on Mar. 28, 2012 in the Japanese Patent Office, the disclosure of which is incorporated herein by reference.

BACKGROUND

The present invention relates to an image forming apparatus that forms an image on a sheet.

For example, an image forming apparatus is known in which a driving force is transmitted by a driving pulley and a driven pulley, whose rotational axes are arranged parallel to each other, and by an endless belt looped around and stretched between the driving pulley and the driven pulley.

SUMMARY

In recent years, further downsizing of an image forming apparatus is desired. In an image forming apparatus in which a driving force is transmitted by a belt, it is preferable that further downsizing is enabled.

The present invention provides an image forming apparatus provided with an image forming unit that forms an image on a sheet. The image forming apparatus includes a movable member, a cover, a link, a driving pulley and a driven pulley, and an endless belt. The movable member is configured to be displaced relative to an apparatus main body. The cover is configured to be displaced between a position where an opening portion provided on the apparatus main body is opened and a position where the opening portion is closed. The link transmits displacement of the cover to the movable member and displaces the movable member in conjunction with the cover. Rotational axes of the driving pulley and the driven pulley are arranged parallel to each other. The belt is looped around and stretched between the driving pulley and the driven pulley, and transmits a driving force from the driving pulley to the driven pulley. The belt overlaps with the link in a direction parallel to the rotational axis of the driving pulley.

Due to such a configuration, in one embodiment of the present invention, a space in which the belt is arranged can be effectively utilized and, therefore, downsizing of the image forming apparatus can be sought.

In other words, if the link and the belt do not overlap with each other in the direction parallel to the rotational axis, a configuration is necessitated in which the link is arranged in a space different from that including the belt arranged therein. Thus, a separate space for arrangement of the link would be additionally required, which leads to upsizing of the image forming apparatus.

In contrast to this, in the present invention, the link and the belt overlap with each other in the direction parallel to the rotational axis and, therefore, the space in which the belt is arranged can be utilized. As a result, downsizing of the image forming apparatus can be sought.

BRIEF DESCRIPTION OF THE DRAWINGS

An embodiment of the present invention will be described hereinafter with reference to the accompanying drawings, in which.

It is to be understood that invention-specifying matters and the like as set forth in the claims are not limited to specific means, structures, and the like as shown in the embodiments below.

DETAILED DESCRIPTION OF THE PREFERRED EMBODIMENTS

The following embodiment is an example in which the present invention is applied to a monochrome printer.

1. Outline of Image Forming Apparatus

Figure 1:
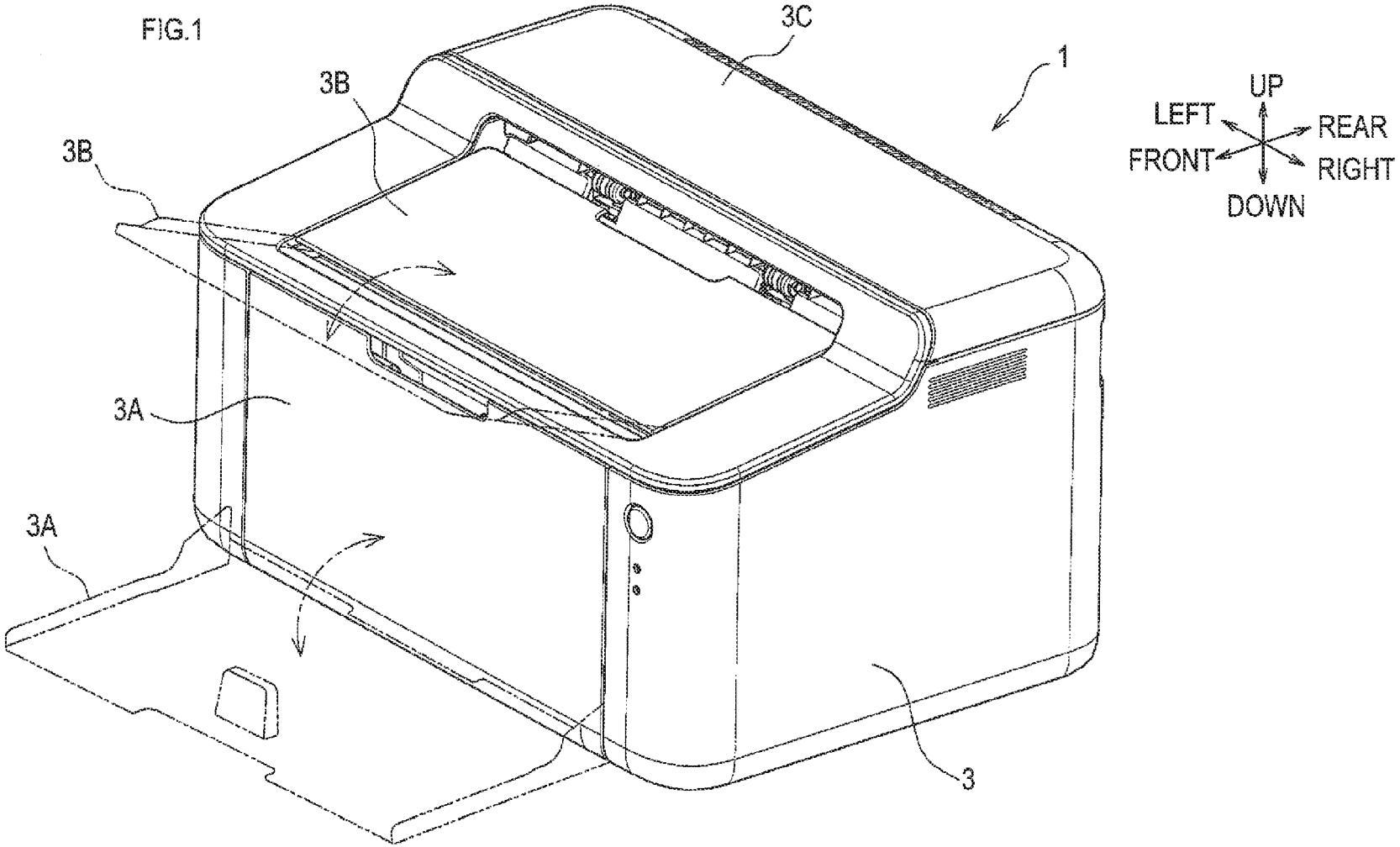
FIG. 1 is an external perspective view of an image forming apparatus according to one embodiment of the present invention.

As shown in FIG. 1, an image forming apparatus 1 according to the present embodiment is a printer having a later-described image forming unit 5 housed in a housing 3 configured in an approximately rectangular parallelepiped shape. On a front side of the housing 3, a paper feed cover 3A is swingably mounted. On an upper side of the housing 3, a paper discharge cover 3B is swingably mounted.

In order to form an image on a sheet, the paper feed cover 3A and the paper discharge cover 3B are opened by being rotated to a front side as shown by two-dot chain lines, and a sheet is placed on the opened paper feed cover 3A. The sheet placed on the paper feed cover 3A is conveyed (fed) to the image forming unit 5 in the housing 3. Then, an image is formed on the sheet by the image forming unit 5. The sheet on which the image is formed is discharged onto the paper discharge cover 3B.

Figure 2:
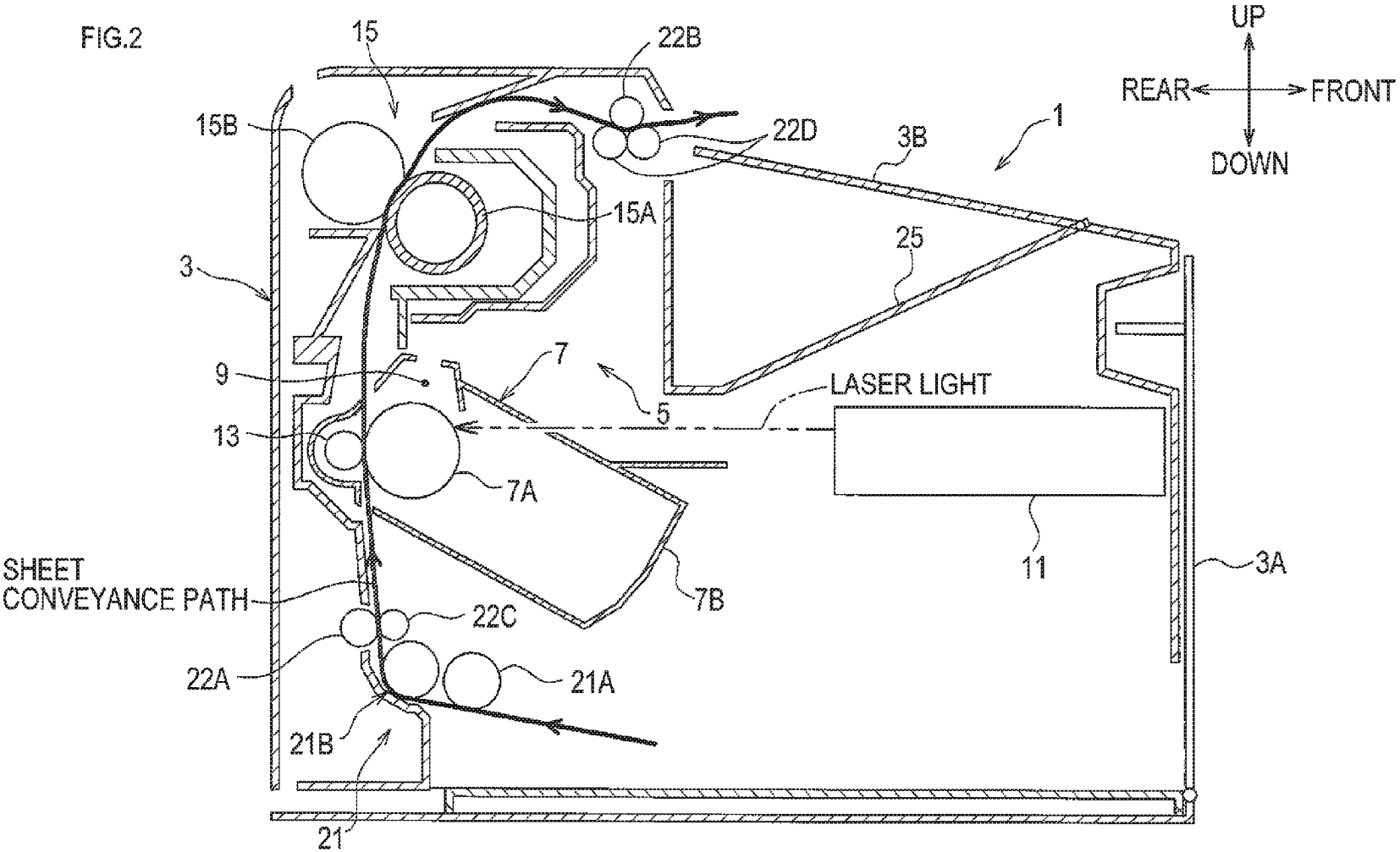
FIG. 2 is a schematic diagram showing a central section of the image forming apparatus according to the embodiment of the present invention.

The image forming unit 5 forms an image on a sheet. As shown in FIG. 2, the image forming unit 5 is an electrophotographic image forming unit including a photoconductor drum 7A, an electrifier 9, an exposer 11, a transfer roller 13, a fuser 15, and the like. The photoconductor drum 7A carries a developer image. The electrifier 9 electrifies a surface of the photoconductor drum 7A. The exposer 11 exposes the electrified photoconductor drum 7A to form an electrostatic latent image. The transfer roller 13 transfers the developer carried by the photoconductor drum 7A to a sheet. The fuser 15 fixes the developer transferred to the sheet.

The photoconductor drum 7A is driven to rotate while housed in a process casing 7B. In the process casing 7B, a developing mechanism (not shown) is provided, which supplies the photoconductor drum 7A with a developer stored inside the process casing 7B. In the present embodiment, the photoconductor drum 7A, the developing mechanism, and the like may be handled as a single process unit 7.

The process unit 7 is detachably attached to a main body (hereinafter referred to as an apparatus main body) of the image forming apparatus 1. The apparatus main body refers to a part, such as a pair of frames 17 (see, e.g., FIG. 3), the housing 3, and the like, which is not attached/detached or disassembled by a user during normal use. The pair of frames 17 is an approximately plate-like structural member. The pair of frames 17 is provided in such a manner as to sandwich therebetween the image forming unit 5, such as the process unit 7. In other words, the pair of frames 17 is arranged on both sides of the image forming unit 5. The pair of frames 17 according to the present embodiment is formed of resin.

An operation body, such as the photoconductor drum 7A and the developing mechanism housed in the process unit 7, operates by receiving a driving force from a driving source 19 provided in the apparatus main body. The driving source 19 is a unit, such as an electric motor, which generates a rotational driving force, and is mounted to either of the pair of frames 17.

As shown in FIG. 2, the fuser 15 includes a heating roller 15A and a press roller 15B. The heating roller 15A heats a sheet while rotating by receiving a driving force from the driving source 19. The press roller 15B is driven to rotate with conveyance of the sheet, while pressing the sheet against the heating roller 15A.

A feeder mechanism 21 conveys the sheet placed on the paper feed cover 3A to the image forming unit 5. The feeder mechanism 21 includes a pickup roller 21A that rotates by receiving a driving force from the driving source 19 (shown in FIG. 3), and a separation unit 21B.

A plurality of sheets are placed in a stacked state on the paper feed cover 3A. The pickup roller 21A rotates while in contact with a single sheet positioned on one end side in a stacked direction of the plurality of sheets. If a plurality of sheets are fed from the pickup roller 21A, the separation unit 21B separates such sheets into each single sheet, and feeds the sheet to a side of the image forming unit 5.

A conveying roller 22A conveys the sheet fed from the separation unit 21B to a side of the photoconductor drum 7A and the transfer roller 13. A discharge roller 22B discharges the sheet discharged from the fuser 15, to a side of the paper discharge cover 3B.

A press roller 22C is driven to rotate with conveyance of the sheet, while pressing the sheet against the conveying roller 22A. A pair of press rollers 22D is driven to rotate with movement of the sheet, while pressing the sheet against the discharge roller 22B to remove a bend (curl) of the sheet.

2. Transmission of Driving Force of Driving Source

2.1. Transmission of Driving Force to Process Unit

Figure 3:
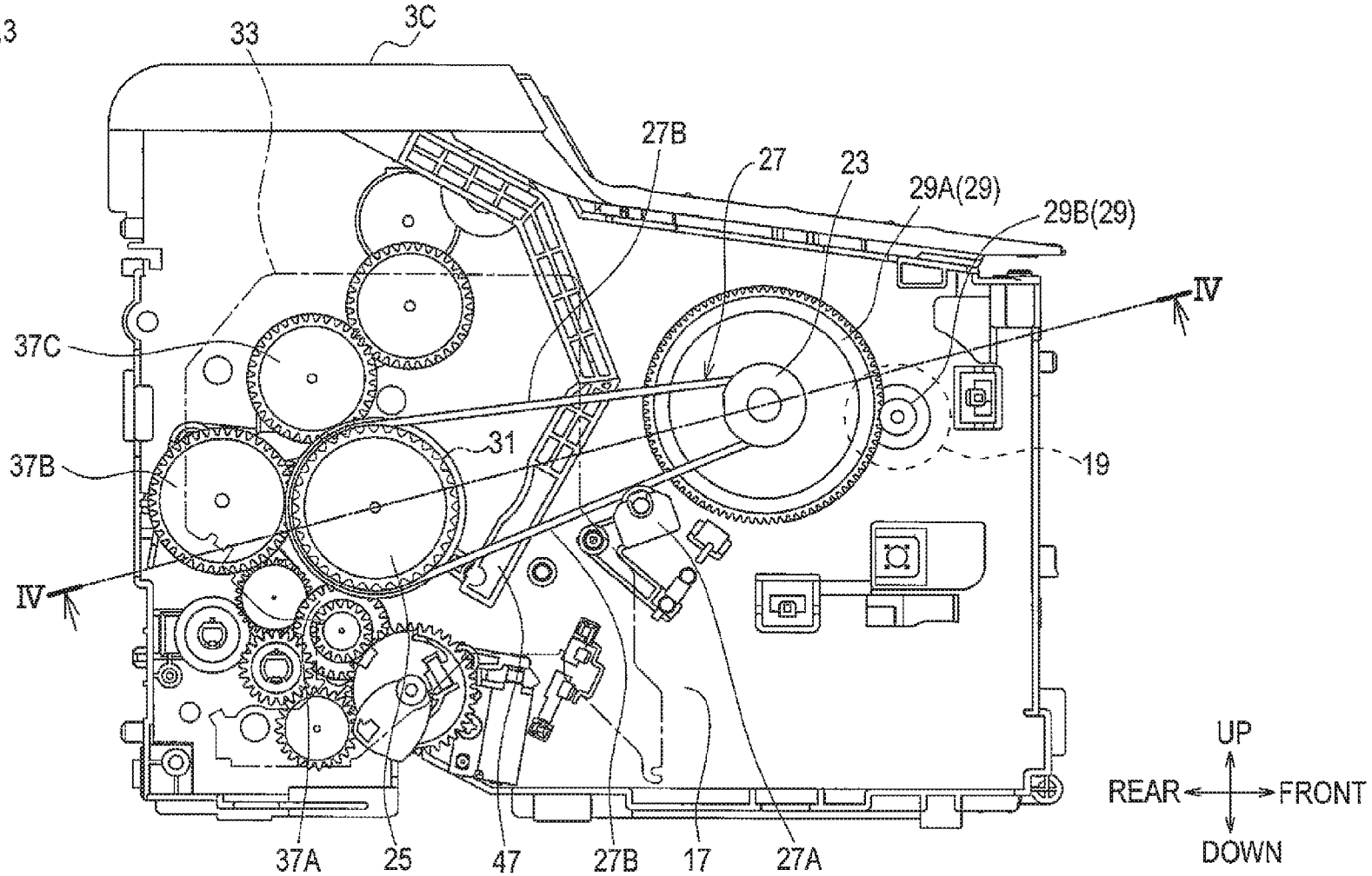
FIG. 3 is a diagram showing a driving pulley, a driven pulley, and the like mounted to a left frame of the image forming apparatus according to the embodiment of the present invention.

As shown in FIG. 3, a driving pulley 23 and a driven pulley 25, whose rotational axes are arranged parallel to each other, are mounted to one of the pair of frames 17 to which the driving source 19 is mounted, from among the pair of frames 17.

Hereinafter, when the pair of frames 17 is referred to merely as the frame 17, the frame 17 means the one to which the driving source 19 is mounted, from among the pair of frames 17.

An endless belt 27 is looped around and stretched between the driving pulley 23 and the driven pulley 25. Thus, a driving force is transmitted from the driving pulley 23 to the driven pulley 25 via the belt 27. The belt 27 according to the present embodiment is a toothed belt having concavities and convexities provided thereon. The concavities and convexities engage with concave and convex portions provided on an outer periphery of the driving pulley 23 and on an outer periphery of the driven pulley 25.

The driving force of the driving source 19 is reduced by a reducer 29, and the reduced driving force is transmitted to the driving pulley 23. The reducer 29 is a gear mechanism including a large diameter gear 29A and a small diameter gear 29B. The large diameter gear 29A is arranged coaxially with the driving pulley 23 and rotates integrally therewith. The small diameter gear 29B engages with the large diameter gear 29A, and is driven by the driving source 19.

Figure 4:
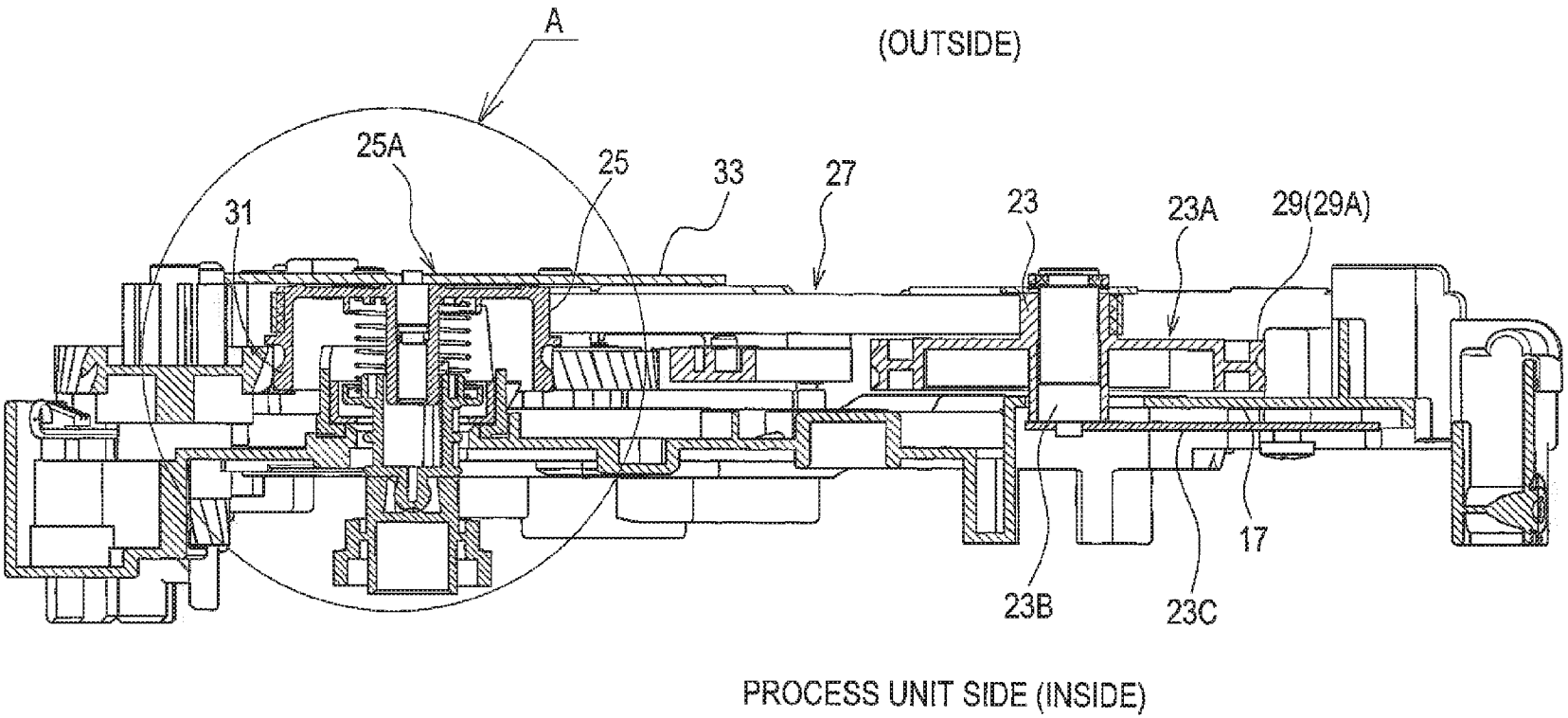
FIG. 4 is a cross-sectional view taken along line IV-IV in FIG. 3.

As shown in FIG. 4, the driving pulley 23 and the large diameter gear 29A are integrally formed of resin to constitute a first rotating body 23A. The large diameter gear 29A is an example of a driving rotary unit, which rotates integrally with the driving pulley 23 that rotates by receiving the driving force from the driving source 19.

The driving pulley 23 is provided on an opposite side of the frame 17 across the large diameter gear 29A. A shaft unit 23B that rotatably supports the first rotating body 23A is mounted and fixed to a first plate 23C of metal, which is mounted and fixed to the frame 17.

The first plate 23C is fixed to the frame 17 with a mechanical fastening member such as a screw (not shown) in such a state as to be arranged on the same side as the process unit 7 with respect to the frame 17. The shaft unit 23B is fixed to the first plate 23C and penetrates the frame 17 to reach a side of the first rotating body 23A.

The driven pulley 25 is an example of an inputting rotary unit that rotates by receiving a driving force via the belt 27. An output gear 31 is an example of an outputting rotary unit, which is provided coaxially with the driven pulley 25 and rotates integrally therewith to output a driving force. The output gear 31 according to the present embodiment is a helical gear whose tooth trace direction is oblique to a rotational axis line.

In the present embodiment, the driven pulley 25 and the output gear 31 are integrally formed of resin to constitute a second rotating body 25A. Thus, the second rotating body 25A rotates by receiving a driving force from a driving source 19 via the belt 27.

Figure 5:
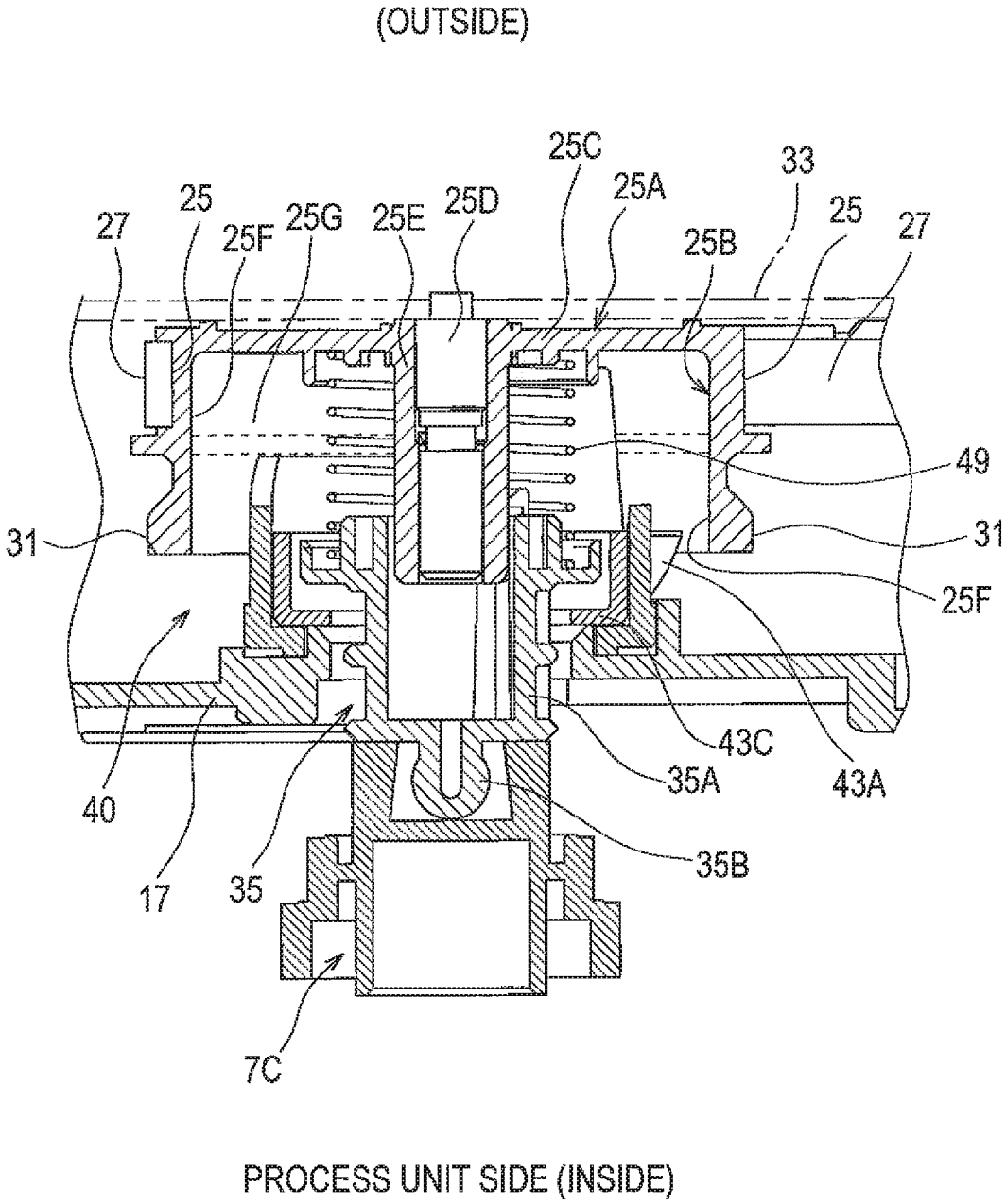
FIG. 5 is a detailed diagram of part A in FIG. 4, showing an engaged position.

As shown in FIG. 5, the second rotating body 25A includes a cylindrical portion 25B, a hub portion 25C, and a bearing portion 25E of a cylinder-like shape. The cylindrical portion 25B is formed into an approximately cylindrical shape. The hub portion 25C is integrated with the cylindrical portion 25B in such a manner as to close one end side of the cylindrical portion 25B in an axial direction. Into the bearing portion 25E, a shaft unit 25D is inserted. The second rotating body 25A is rotatably supported by the shaft unit 25D.

The driven pulley 25 and the output gear 31 are provided on an outer peripheral surface side of the cylindrical portion 25B, and are formed of resin integrally with the cylindrical portion 25B, the hub portion 25C, and the bearing portion 25E. The other end of the cylindrical portion 25B in the axial direction is open, and an inner peripheral surface 25F of the cylindrical portion 25B is configured in a columnar surface-like shape parallel to the axial direction. Thus, a space 25G of an approximately columnar shape is constituted on an inner periphery side of the cylindrical portion 25B.

The bearing portion 25E is integrated with the second rotating body 25A according to the present embodiment. In the cross-sectional view of FIG. 5, the second rotating body 25A has a concave portion in its central portion, and has a convex portion around the central portion. The space 25G constitutes an inner space of the convex portion. In other words, the second rotating body 25A has a shape similar to that of a chiffon cake pan.

Figure 7:
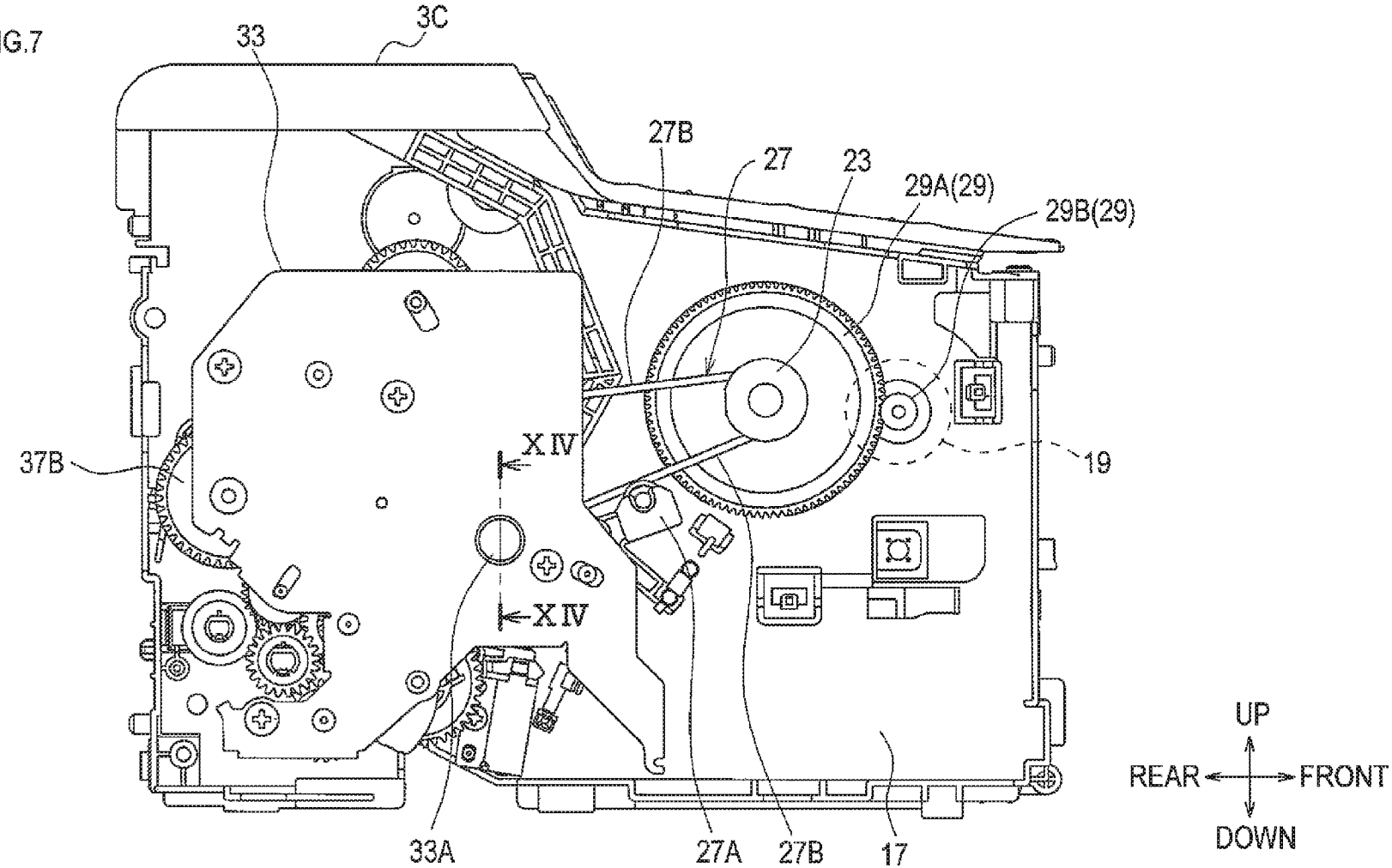
FIG. 7 is a diagram showing the driving pulley and the like mounted to the left frame in the image forming apparatus according to the embodiment of the present invention.

The shaft unit 25D is, at one end side thereof in an axial direction thereof, supported by and fixed to a second plate 33 of metal. As shown in FIG. 7, the second plate 33 is fixed to the frame 17 in such a manner as to cover the second rotating body 25A. The second plate 33 is arranged on an opposite side of the frame 17 across the second rotating body 25A.

Therefore, the shaft unit 25D according to the present embodiment has a cantilever structure, in which the shaft unit 25D is supported only on a side of the second plate 33, and the second plate 33 functions as a supporting part that supports the second rotating body 25A. As shown in FIG. 5, the driven pulley 25 is provided on a side closer to the second plate 33 rather than on a side of the output gear 31, on the cylindrical portion 25B.

The second plate 33 is fixed to the frame 17 with a mechanical fastening member such as a screw. As shown in FIG. 3, a predetermined tension is applied to the belt 27 by a tensioner 27A utilizing an elastic member such as a spring.

Figure 6:
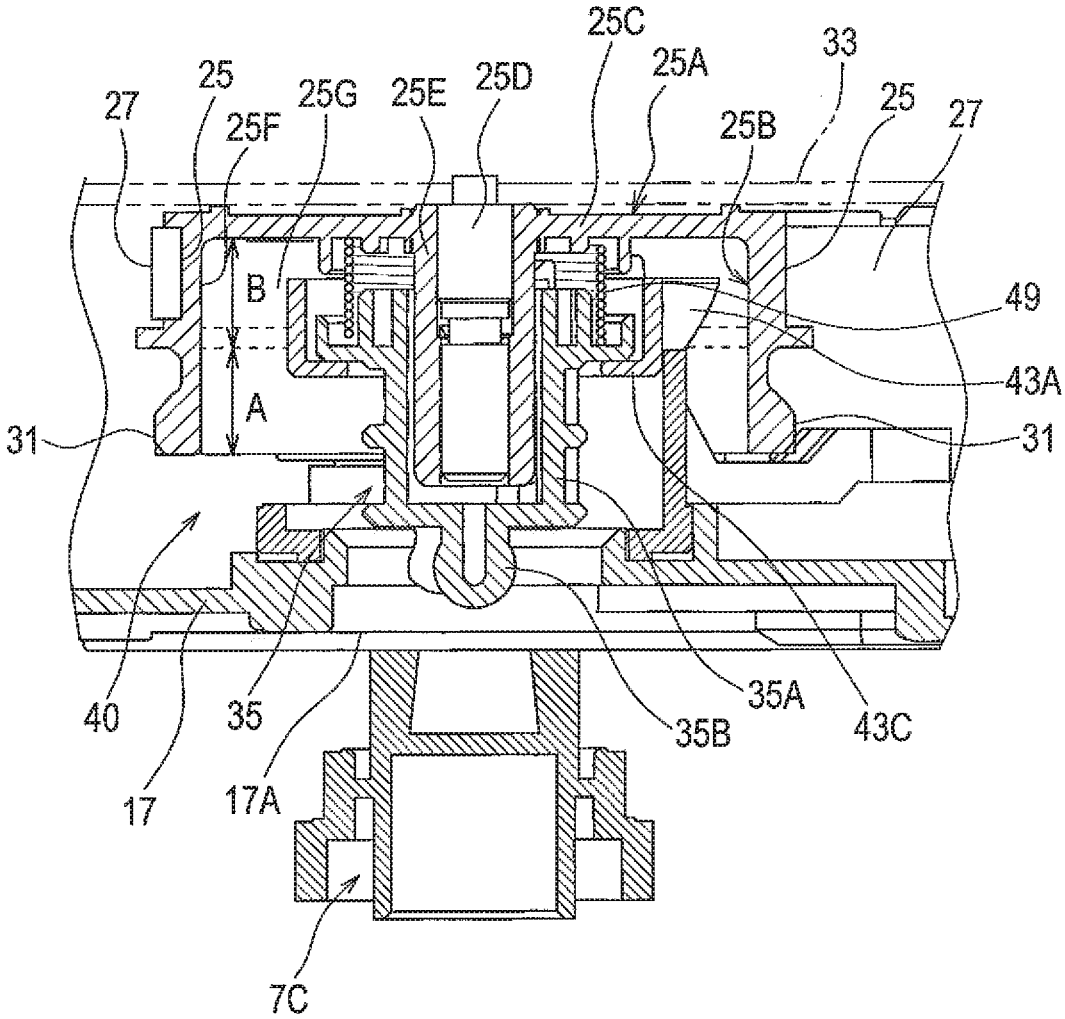
FIG. 6 is a detailed diagram of part A in FIG. 4, showing a non-engaged position.

In the space 25G within the second rotating body 25A, a coupling unit 35 that rotates by receiving a driving force from the second rotating body 25A is housed (see, e.g., FIG. 6). The coupling unit 35 is arranged coaxially with the second rotating body 25A, and is configured to be displaced in an axial direction thereof. The coupling unit 35 is displaced in the axial direction to thereby intermittently transmit a driving force to the process unit 7. Details of a driving mechanism that displaces the coupling unit 35 will be described later.

The coupling unit 35 is an example of a movable member including a movable portion 35A of an approximately tubular shape; and an engaging portion 35B that engages with an engaged portion 7C provided on the process unit 7. The engaged portion 7C is a transmission portion that transmits the driving force transmitted from the coupling unit 35, to the operation body such as the photoconductor drum 7A.

The movable portion 35A is configured to be displaced in an axial direction thereof while engaged with the bearing portion 25E. The engaging portion 35B is integrated with the movable portion 35A at one end side thereof in an axial direction thereof. Thus, as shown in FIG. 5, when the coupling unit 35 is displaced to a side of the process unit 7, and the engaging portion 35B and the engaged portion 7C engage with each other, it becomes possible to transmit the driving force from the second rotating body 25A (i.e., the driven pulley 25) to the process unit 7 via the coupling unit 35.

In contrast, as shown in FIG. 6, when the coupling unit 35 is displaced to a side of the second plate 33 to thereby be spaced apart from the process unit 7, the engagement between the engaging portion 35B and the engaged portion 7C is released. As a result, a transmission path of the driving force from the second rotating body 25A, i.e., the driven pulley 25, to the process unit 7 is interrupted.

When the coupling unit 35 is spaced apart from the process unit 7, the whole of the engaging portion 35B is brought into a depressed state with respect to an inner surface 17A of the frame 17, i.e., a surface of the frame 17 on a side of the process unit 7, toward a side of the second rotating body 25A. At the same time, the coupling unit 35 is housed into a region corresponding to the driven pulley 25 and the output gear 31, in the space 25G.

In the present embodiment, the state in which "the coupling unit 35 is housed into a region corresponding to the driven pulley 25 and the output gear 31, in the space 25G" refers to a state in which another end side of the coupling unit 35 in a longitudinal direction, i.e., an opposite end of the engaging portion 35B, crosses a region A corresponding to the output gear 31 in the space 25G and reaches a region B corresponding to the driven pulley 25.

2.2. Transmission of Driving Force to Feeder Mechanism etc.

The operation body such as the photoconductor drum 7A housed in the process unit 7 is rotated to operate by a driving force transmitted from the second rotating body 25A via the coupling unit 35. On the other hand, a conveyance mechanism such as the feeder mechanism 21, the fuser 15, and various kinds of conveying rollers rotate by receiving a driving force via transmission gears 37A-37C that engage with the output gear 31, as shown in FIG. 3.

The transmission gear 37A transmits a driving force to a side of the pickup roller 21A constituting the feeder mechanism 21 and to a side of the conveying roller 22A. The transmission gear 37B transmits a driving force to a side of the transfer roller 13. The transmission gear 37C transmits a driving force to a side of the heating roller 15A and the discharge roller 22B. The transmission gears 37A-37C and gears engaging therewith are rotatably supported by the frame 17.

3. Drive Mechanism of Coupling unit

3.1. Configuration and Operation of Drive Mechanism

A drive mechanism 40 displaces the coupling unit 35 between a position where the engaging portion 35B and the engaged portion 7C engage with each other as shown in FIG. 5; and a position where the engaging portion 35B and the engaged portion 7C are brought into a non-engaged state as shown in FIG. 6. Hereinafter, the position of the coupling unit 35 as shown in FIG. 5 is referred to as an engaged position, and the position of the coupling unit 35 as shown in FIG. 6 is referred to as a non-engaged position.

An explanation will be given below as to a general configuration and a general operation of the drive mechanism 40. A basic configuration of the drive mechanism 40 and an operation thereof are similar to those of the invention as set forth in Unexamined Japanese Patent Publication No. 2008-304704, for example.

Figure 8:
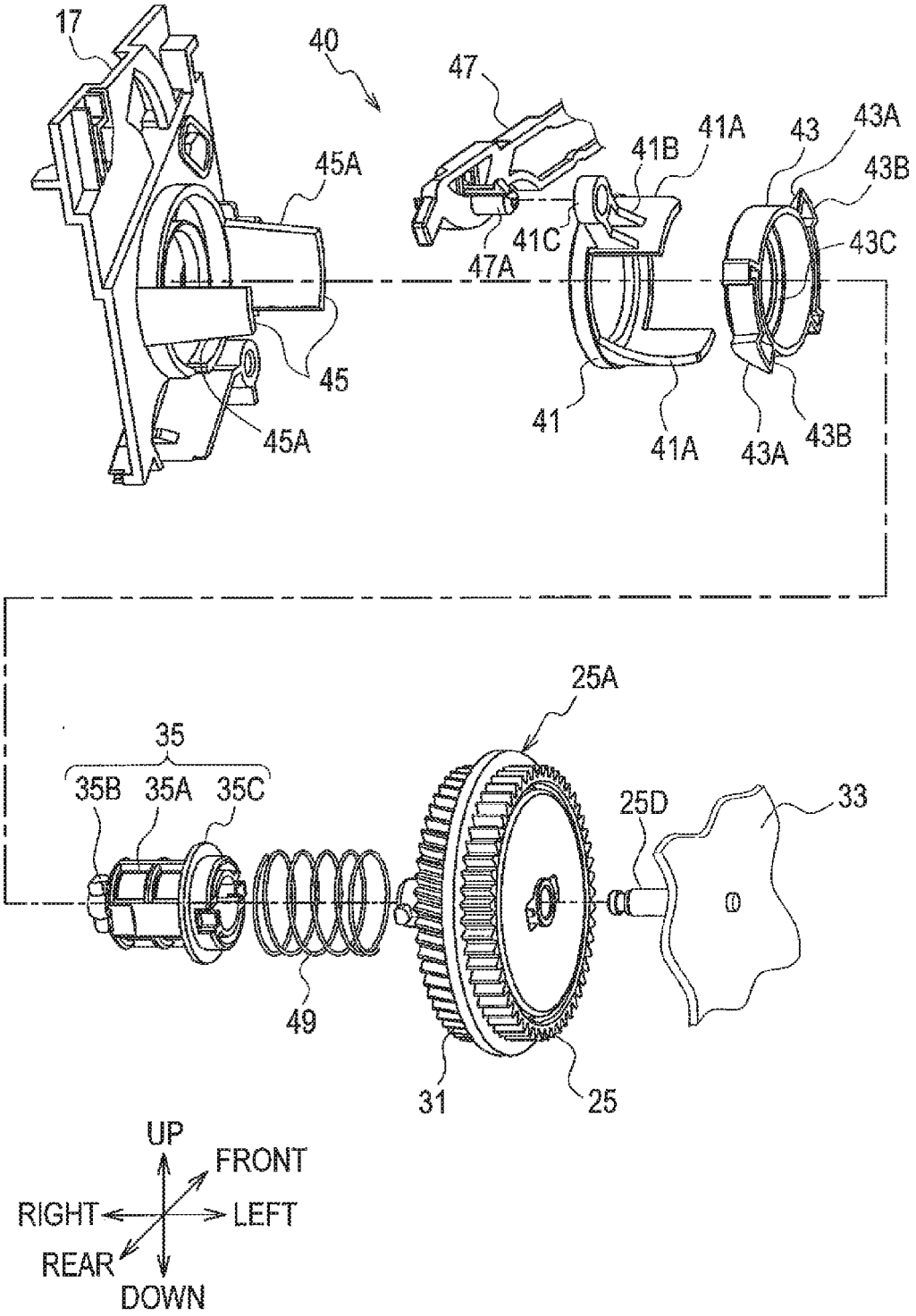
FIG. 8 is an exploded perspective view of a drive mechanism according to the embodiment of the present invention.

As shown in FIG. 8, the drive mechanism 40 includes the coupling unit 35, a rotating cam 41, a translation cam 43, a control cam 45, a link 47, and a spring 49.

Figure 9:
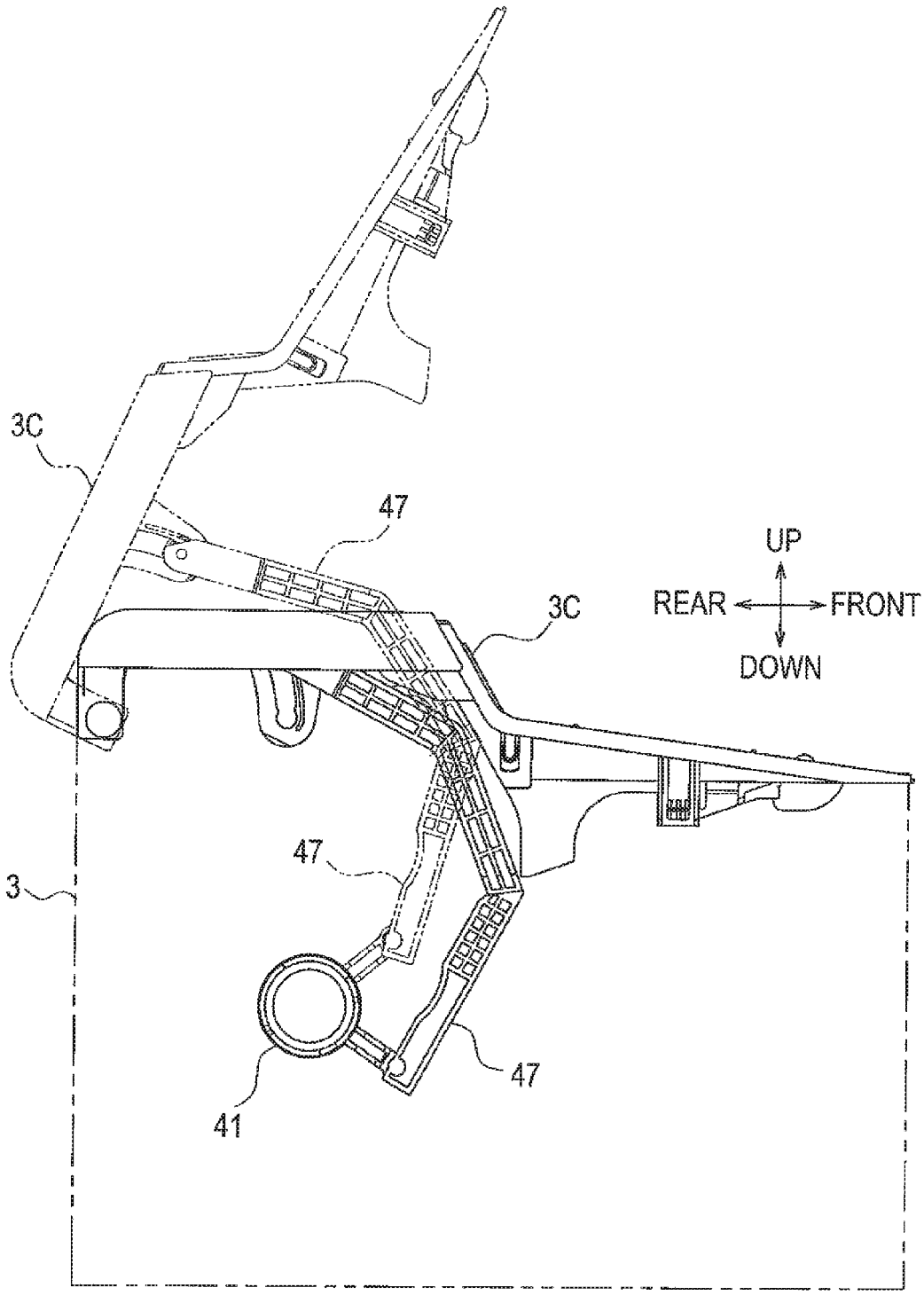
FIG. 9 is a diagram showing opening/closing operation of a top cover.

As shown in FIG. 9, the rotating cam 41 is coupled to a top cover 3C via the link 47. Thus, the rotating cam 41 rotates relative to the frame 17 around the shaft unit 25D in conjunction with opening/closing of the top cover 3C.

The top cover 3C is swingably mounted to the housing 3, and swung to be displaced between a position where an opening portion provided on the housing 3 is opened and a position where the opening portion is closed. The opening portion according to the present embodiment is provided on an upper part of the housing 3. For example, when the process unit 7 is to be replaced, the opening portion is opened and the process unit 7 is detached from/attached to the apparatus main body.

As shown in FIG. 8, the rotating cam 41 includes a sliding surface 41A (hereinafter referred to as a first sliding surface 41A) of an approximately spiral shape, a central axis of which is a rotational axis of the rotating cam 41. The translation cam 43, which includes a sliding contact portion 43B and an engaging portion 43C, is a displacement member displaced in an axial direction in accordance with a rotation angle of the rotating cam 41.

Formed on the sliding contact portion 43B is a sliding surface 43A that slidably contacts the first sliding surface 41A of the rotating cam 41. The engaging portion 43C is a region that engages with a flange portion 35C of a flange shape provided on the coupling unit 35.

Figure 10:
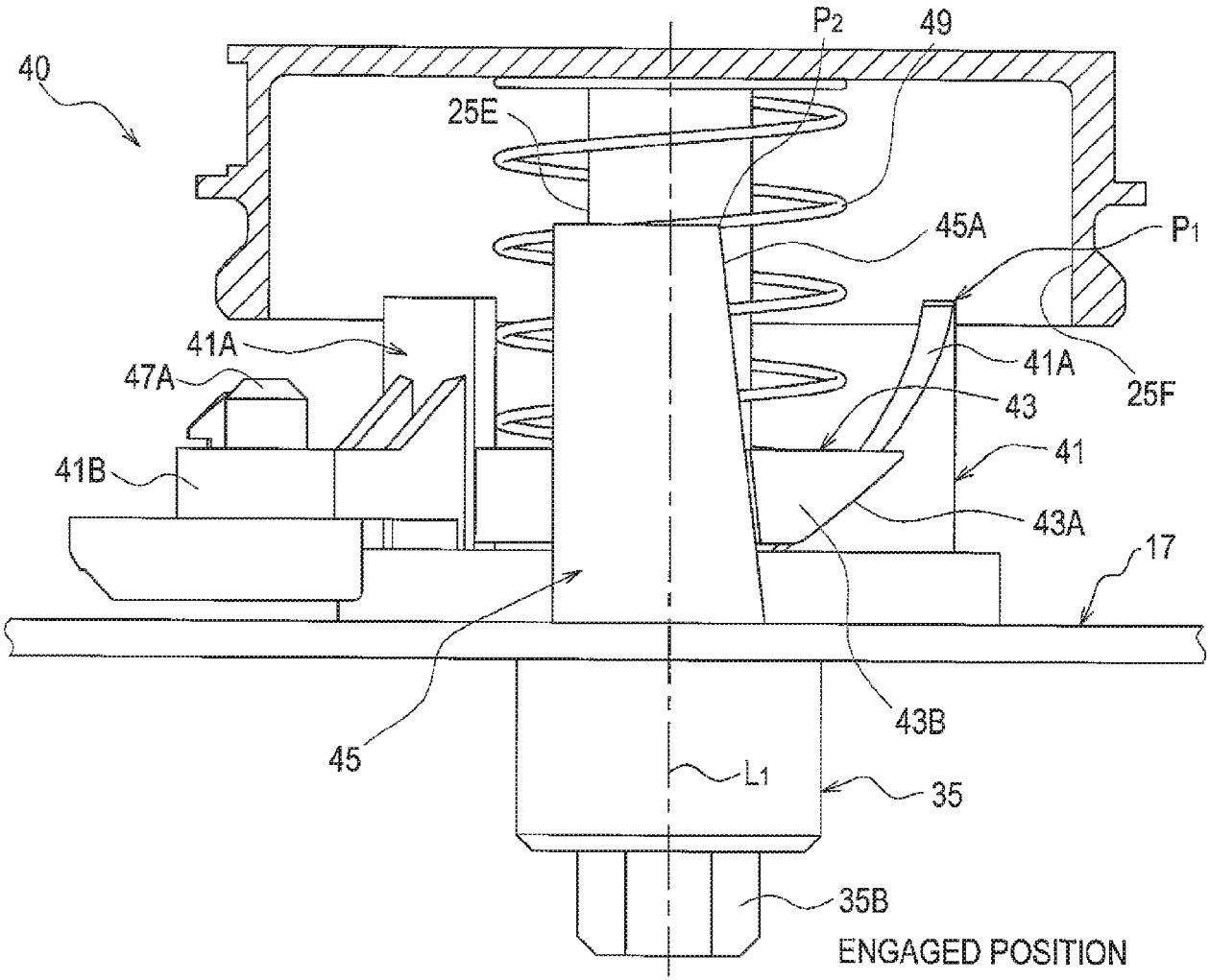
FIG. 10 is an explanatory diagram showing an operation of the drive mechanism according to the embodiment of the present invention.
Figure 11:
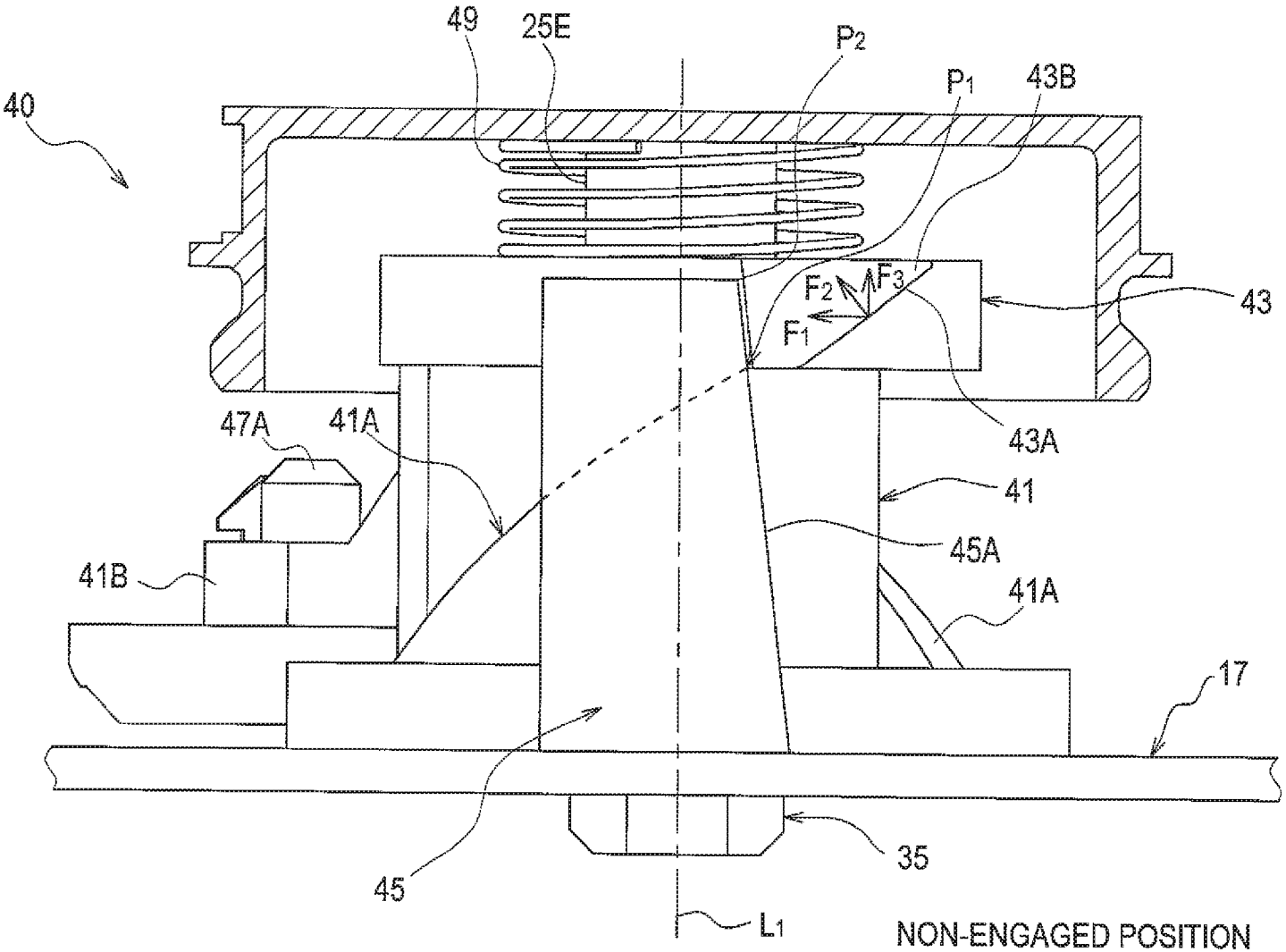
FIG. 11 is an explanatory diagram showing an operation of the drive mechanism according to the embodiment of the present invention.

As shown in FIG. 10 and FIG. 11, the translation cam 43 is displaced while sliding along the first sliding surface 41A in conjunction with rotation of the rotating cam 41, and the translation cam 43 is displaced in an axial direction L1 together with the coupling unit 35 due to the principle of screw (a wedge effect).

As shown in FIG. 10, the control cam 45 includes a sliding surface 45A (hereinafter referred to as a second sliding surface 45A) that slidably contacts the sliding contact portion 43B from an opposite side of the first sliding surface 41A across the sliding contact portion 43B of the translation cam 43. Each of the second sliding surface 45A, the first sliding surface 41A, and the sliding surface 43A is provided by two, so as to be rotationally symmetric with respect to a rotational axis of the rotating cam 41.

As shown in FIG. 10 and FIG. 11, the second sliding surface 45A is tilted in a direction opposite to that of a spiral inclination depicted by the first sliding surface 41A. Thus, when the rotating cam 41 is rotated, the translation cam 43 is displaced along the axial direction L1 in conjunction with the rotation of the rotating cam 41, while displacing the coupling unit 35 along the axial direction L1 as shown in FIG. 10 and FIG. 11.

For example, when the rotating cam 41 is rotated in such a manner that an end point P1 of the first sliding surface 41A and an end point P2 of the second sliding surface 45A come relatively closer to each other, as shown in FIG. 11, the sliding surface 43A and the first sliding surface 41A come into contact with each other to press the sliding contact portion 43B of the translation cam 43 against the second sliding surface 45A.

At this point, the second sliding surface 45A, i.e., the control cam 45, is not moved. Therefore, when the rotating cam 41 is rotated in such a manner that the first sliding surface 41A and the second sliding surface 45A come closer to each other, a force F3 to move the sliding contact portion 43B in a direction in which the spring 49 is compressed and deformed (such a force is hereinafter referred to as a compressive force F3) is generated on a contact surface between the sliding contact portion 43B and the first sliding surface 41A and on a contact surface between the sliding contact portion 43B and the second sliding surface 45A.

Thus, the translation cam 43 is displaced in a direction of the compressive force F3, and the coupling unit 35 is moved from the engaged position to a side of the non-engaged position. A force F1 is a force to rotate the rotating cam 41, and a force F2 is a component of the force F1, which is perpendicular to the first sliding surface 41A and the sliding surface 43A. The compressive force F3 is a component of the force F2, which is parallel to the axial direction L1.

As shown in FIG. 10, when the rotating cam 41 is rotated in such a manner that the end point P1 of the first sliding surface 41A and the end point P2 of the second sliding surface 45A are relatively spaced apart from each other, the force F1 disappears, and at the same time, the compressive force F3 also disappears. As a result, the spring 49 is restored and expanded. Thus, the translation cam 43 is pressed by the spring 49 to move in a direction opposite to that of the compressive force F3, to thereby move the coupling unit 35 from the non-engaged position to a side of the engaged position.

As shown in FIG. 9, one end side of the link 47 is rotatably mounted to the rotating cam 41, and the other end side is rotatably mounted to the top cover 3C. The opening/closing operation of the top cover 3C is converted into a rotational movement of the rotating cam 41 by the link 47. Therefore, in conjunction with swing and displacement of the top cover 3C, the coupling unit 35 is displaced along the axial direction L1.

In the present embodiment, when the top cover 3C is in an open state as shown by two-dot chain lines, the coupling unit 35 is brought into a non-engaged position, and when the top cover 3C is in a closed state as shown by solid lines, the coupling unit 35 is brought into an engaged position.

As shown in FIG. 8, on the one end side of the link 47, a boss portion 47A of a pin-like shape is provided. On the other hand, provided on the rotating cam 41 is an arm portion 41B extending across the control cam 45 to an outside thereof in a radial direction. The link 47 and the rotating cam 41 are rotatably coupled to each other by rotatably inserting the boss portion 47A into a coupling hole 41C formed on a tip side of the arm portion 41B.

3.2. Link of Drive Mechanism

As shown in FIG. 3, the link 47 and the belt 27 overlap with each other in a direction parallel to the rotational axis of the driving pulley 23. In other words, when the link 47 and the belt 27 are viewed from the direction parallel to the rotational axis of the driving pulley 23, the link 47 extends in a direction that intersects with a pair of stretching portions 27B of the belt 27. The stretching portion 27B of the belt 27 refers to a portion in the belt 27, which linearly extends in a direction of tangent to the driving pulley 23 and the driven pulley 25.

Figure 12B:
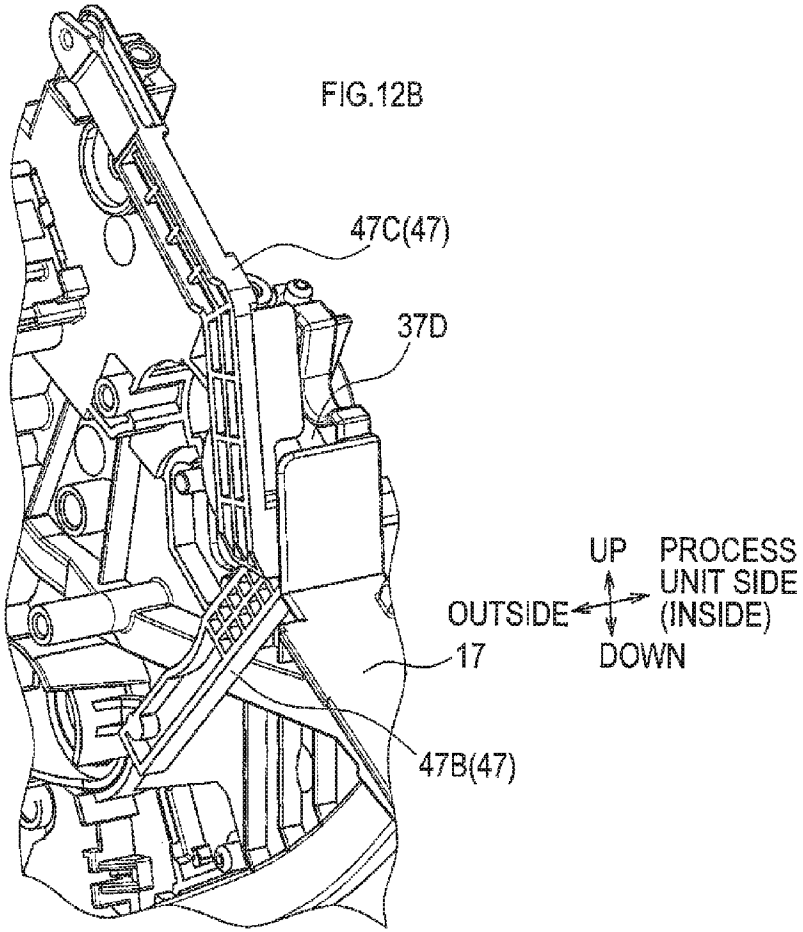
FIGS. 12A and 12B are diagrams to explain a shape of a link.
Figure 12A:
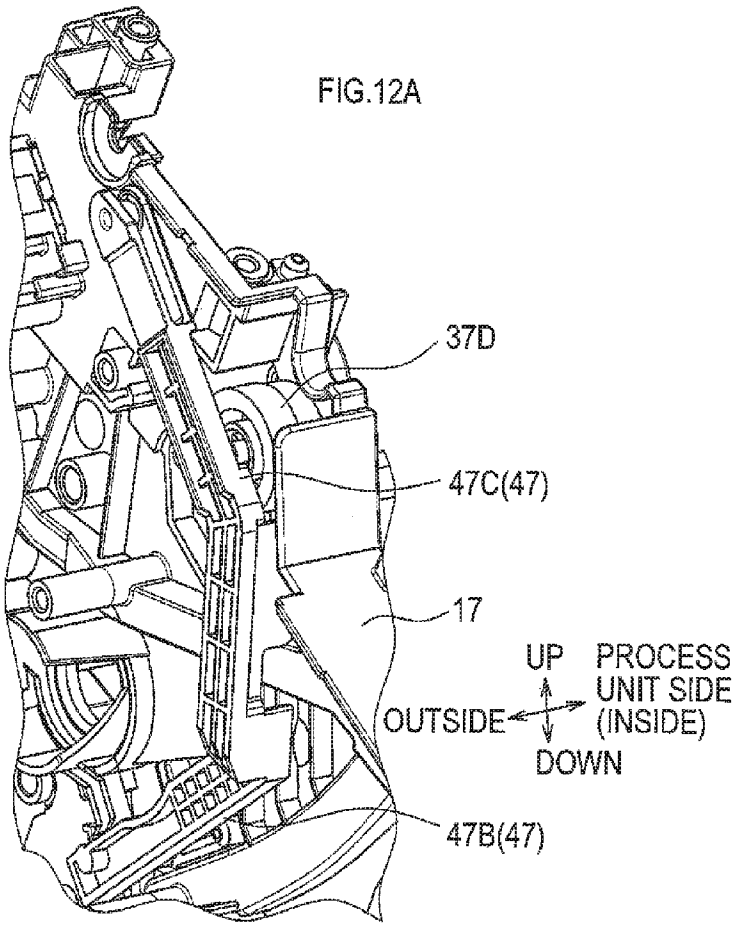

As shown in FIGS. 12A and 12B, the link 47 includes a first link portion 47B and a second link portion 47C. The first link portion 47B overlaps with the belt 27 in the direction parallel to the rotational axis of the driving pulley 23. The second link portion 47C deviates with respect to the first link portion 47B in such a direction. In the present embodiment, the first link portion 47B and the second link portion 47C are integrally formed of resin.

At least the first link portion 47B in the link 47 is arranged between the frame 17 and the belt 27. In the present embodiment, the second link portion 47C deviates with respect to the first link portion 47B to an opposite side of the frame 17 (i.e., to a same side as the belt 27).

A reason why the second link portion 47C deviates with respect to the first link portion 47B to the side of the belt 27 is to avoid interference with a transmission gear 37D that transmits a driving force to a side of the discharge roller 22B. Thus, if there is nothing, such as the transmission gear 37D, which interferes with the link 47 when the link 47 operates, a configuration may be adopted in which the whole of the link 47 is positioned on a side closer to the frame 17 than the belt 27 without deviating the second link portion 47C with respect to the first link portion 47B.

Figure 13B:
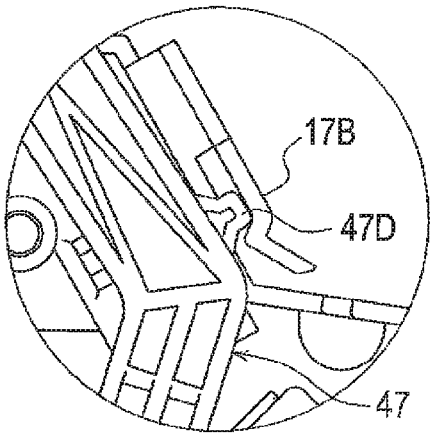
FIG. 13B is an enlarged view of part A in FIG. 13A.
Figure 13A:
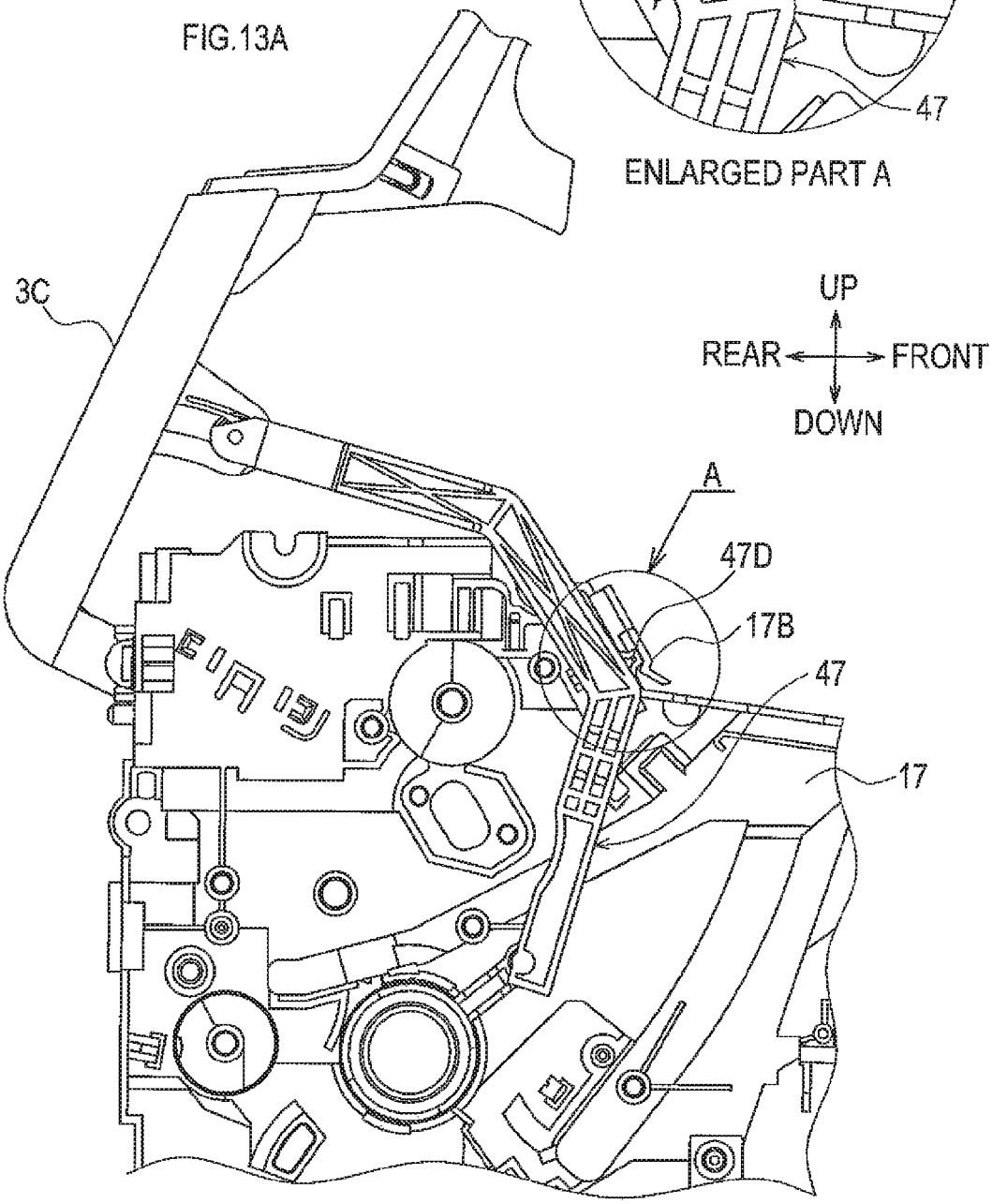
FIG. 13A is a diagram showing a state in which the top cover is opened.

As shown in FIG. 13, provided on the frame 17 is a retention portion 17B, which locks the link 47 when the top cover 3C is opened and retains a state in which the top cover 3C is opened. The retention portion 17B is an elastically deformable member that is configured to engage with a locking projection 47D provided on the link 47. In order to release the locking state between the locking projection 47D and the retention portion 17B, it is only necessary to displace the retention portion 17B so that the retention portion 17B is spaced apart from the locking projection 47D. This elastically deforms the retention portion 17B, and releases the locking state between the locking projection 47D and the retention portion 17B.

Figure 14:
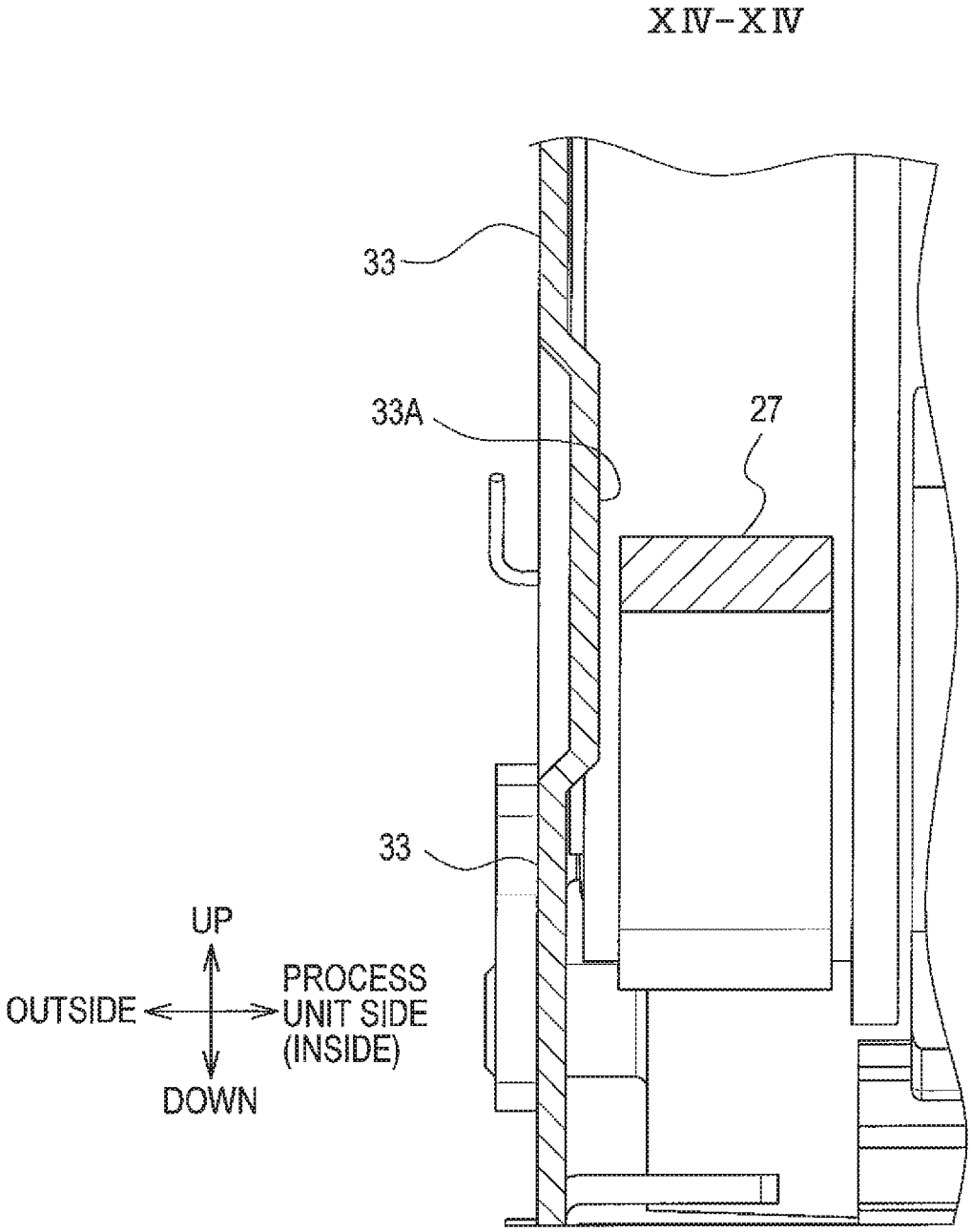
FIG. 14 is a cross-sectional view taken along line XIV-XIV in FIG. 7.

As shown in FIG. 14, on a side of the belt 27 on the second plate 33, a protruding portion 33A is provided which protrudes to a side of the belt 27. The protruding portion 33A is closer to the belt 27 than a region on which the protruding portion 33A is not provided. Thus, the protruding portion 33A functions as a suppression member that suppresses the belt 27 from deviating to a side of the second plate 33 and coming off the driving pulley 23 and the driven pulley 25.

As shown in FIG. 7, the protruding portion 33A according to the present embodiment is provided correspondingly to the stretching portion 27B on a side of the tensioner 27A from among the pair of the stretching portions 27B. However, the protruding portion 33A may be provided correspondingly to a part of each of the pair of the stretching portions 27B or across a whole area of the pair of the stretching portions 27B.

In the present embodiment, since the link 47 is arranged on a side of the frame 17 rather than a side of the belt 27, the link 47 and the large diameter gear 29A, which is an example of a driving rotary unit, are arranged in an overlapping manner in a direction extending from the driving pulley 23 to the driven pulley 25, and also the link 47 and the output gear 31 are arranged in an overlapping manner in such a direction.

4. Features of Image Forming Apparatus According to the Present Embodiment

In the present embodiment, the space 25G, which houses therein at least part of the coupling unit 35 when the coupling unit 35 is spaced apart from the process unit 7, is provided in the second rotating body 25A. Thus, it is possible to house at least part of the coupling unit 35 utilizing a space occupied by the second rotating body 25A. As a result, it is unnecessary to separately secure a space to house the coupling unit 35 and, therefore, downsizing of the image forming apparatus 1 can be realized.

Also, in the present embodiment, the driven pulley 25, which is an example of an inputting rotary unit, and the output gear 31, which is an example of an outputting rotary unit, are provided on an outer peripheral surface side of the cylindrical portion 25B formed into an approximately cylindrical shape. The space 25G is an inner peripheral side space in the cylindrical portion 25B, and when the coupling unit 35 is spaced apart from the process unit 7, the coupling unit 35 is housed in a region corresponding to the driven pulley 25 and the output gear 31, in the space 25G.

Due to such a configuration, in the present embodiment, at least part of the coupling unit 35 may be housed utilizing much of the space occupied by the second rotating body 25A. As a result, further downsizing of the image forming apparatus 1 can be realized. "The cylindrical portion formed into an approximately cylindrical shape" may include a cylindrical portion formed into a cylindrical shape having unevenness such as different levels in an inner peripheral surface thereof, as well as a cylindrical portion formed into a cylindrical shape having no unevenness in the inner peripheral surface thereof.

In addition, the present embodiment is characterized by having the reducer 29 that reduces a driving force of the driving source 19 and transmits the reduced driving force to the driving pulley 23.

This can reduce a movement speed of the belt 27 and suppress the belt 27 from being worn or damaged at an early stage, in the present embodiment.

In the meantime, when a driving force is transmitted by the belt 27, it is necessary, in general, to increase tension of the belt 27 and, therefore, a load due to great tension is applied to the driven pulley 25.

In contrast to this, the present embodiment is characterized in that the second plate 33 supporting the second rotating body 25A is provided at one end side thereof in an axial direction thereof, and in that the driven pulley 25 is provided on a side closer to the second plate 33 rather than on a side of the output gear 31, on the second rotating body 25A. In other words, the driven pulley 25 is provided between the output gear 31 and the second plate 33.

This gives the present embodiment a configuration in which the driven pulley 25 is provided on a region closer to the second plate 33 and, therefore, a defect can be suppressed from occurring such as an inclination of the second rotating body 25A due to the tension applied to the driven pulley 25.

Moreover, the present embodiment is characterized in that the space 25G is a columnar space extending in an axial direction thereof, and in that the inner peripheral surface 25F constituting the space 25G is linear in parallel with an axial direction thereof.

This gives the present embodiment a configuration in which no region constitutes any obstacle when the coupling unit 35 is displaced. As a result, the coupling unit 35 can be easily displaced.

In a case where the driven pulley 25 and the output gear 31 are integrally formed by injection molding or the like to form the space 25G, a mold release operation during molding can be easily performed if a cylindrical inner peripheral surface constituting the space 25G is linear in parallel with an axial direction thereof. As a result, productivity of the second rotating body 25A can be improved.

In a case where the driven pulley 25 and the output gear 31 are integrally formed by injection molding or the like, it is necessary to provide the inner peripheral surface 25F with a gradient for mold release. Therefore, a state in which "the inner peripheral surface 25F is linear in parallel with an axial direction thereof" may include a case in which a minor extent of slope (gradient) required for mold release is provided.

Furthermore, the present embodiment is characterized in that the link 47 and the belt 27 overlap with each other in the direction parallel to the rotational axis of the driving pulley 23.

Due to such a configuration, in the present embodiment, a space in which the belt 27 is arranged can be effectively utilized and, therefore, downsizing of the image forming apparatus 1 can be sought.

In other words, if the link 47 and the belt 27 do not overlap with each other in the direction parallel to the rotational axis, a configuration is necessitated in which the link 47 is arranged in a space different from that including the belt 27 arranged therein. Thus, a separate space for arrangement of the link 47 would be additionally required, which leads to upsizing of the image forming apparatus 1.

In contrast to this, in the present embodiment, the link 47 and the belt 27 overlap with each other in the direction parallel to the rotational axis and, therefore, the space in which the belt 27 is arranged can be utilized. As a result, downsizing of the image forming apparatus 1 can be sought.

Other Embodiments

In the above-described embodiment, the space 25G to house the coupling unit 35 therein is provided within the second rotating body 25A. However, the present invention is not limited to this, and it is possible not to provide the space 25G, for example.

In the above-described embodiment, the coupling unit 35 is housed in the region corresponding to the driven pulley 25 and the output gear 31, in the space 25G. However, the present invention is not limited to this. For example, a configuration may be adopted in which the coupling unit 35 is housed in the region corresponding to the driven pulley 25 or the output gear 31, in the space 25G.

In the above-described embodiment, the coupling unit 35 crosses the region corresponding to the output gear 31, in the space 25G, to reach the region corresponding to the driven pulley 25. However, the present invention is not limited to this. For example, when the driven pulley 25 is positioned on a side closer to the frame 17 than the output gear 31, the coupling unit 35 may cross the region corresponding to the driven pulley 25, in the space 25G, to reach the region corresponding to the output gear 31.

In the above-described embodiment, a configuration is adopted in which the driving force of the driving source 19 is reduced and the reduced driving force is transmitted to the driving pulley 23. However, the present invention is not limited to this. For example, the driving pulley 23 may be directly driven by the driving source 19 without reducing the driving force.

In the above-described embodiment, the shaft unit 25D, which supports the second rotating body 25A, is supported only at one end side thereof in an axial direction thereof, and the driven pulley 25 is provided on a supporting side. However, the present invention is not limited to this. For example, a configuration may be adopted in which the shaft unit 25D is supported at both ends thereof. Alternatively, a configuration may be adopted in which the shaft unit 25D is supported with the output gear 31. Furthermore, still other configurations may be adopted.

In the above-described embodiment, the inner peripheral surface 25F constituting the space 25G is linear in parallel with the axial direction thereof. However, the present invention is not limited to this. For example, the inner peripheral surface 25F may be formed into a tapered or stepped shape such that a side of the output gear 31 has a larger internal diameter than that of a side of the driven pulley 25.

In the above-described embodiment, the driving force is transmitted from the output gear 31 to a side of the fuser 15 and a side of the feeder mechanism 21. However, the present invention is not limited to this.

In the above-described embodiment, the link 47 is bent at a coupling portion between the first link portion 47B and the second link portion 47C. However, the present invention is not limited to this, and the whole of the link 47 may have a linear shape, for example. Alternatively, the link 47 may be bent at a portion other than the above-described coupling portion.

In the above-described embodiment, the present invention is applied to a monochrome electrophotographic image forming apparatus. However, its application is not limited to this. The present invention may be applied, for example, to a direct tandem type image forming apparatus.

The present invention may be modified as long as it meets the spirit of the invention as set forth in the claims, and is not to be limited to the above-described embodiments.

What is claimed is:

1. An image forming apparatus provided with an image forming unit configured to form an image on a sheet, the image forming apparatus comprising:

a movable member configured to be displaced relative to a main body of the image forming apparatus;

a cover configured to be displaced between a position where an opening portion provided on the main body is opened and a position where the opening portion is closed;

a link configured to transmit displacement of the cover to the movable member and to displace the movable member in conjunction with the cover;

a driving pulley and a driven pulley, a rotational axis of the driving pulley being arranged parallel to a rotational axis of the driven pulley; and an endless belt looped around and stretched between the driving pulley and the driven pulley and configured to transmit a driving force from the driving pulley to the driven pulley, wherein the link includes:

a first link portion that overlaps with the belt in a direction parallel to the rotational axis of the driving pulley; and a second link portion that deviates with respect to the first link portion in the direction parallel to the rotational axis of the driving pulley.

2. The image forming apparatus according to claim 1, wherein the link extends in a direction that intersects with a stretching portion of the belt when viewed from the direction parallel to the rotational axis of the driving pulley.

3. The image forming apparatus according to claim 1, comprising:

a driving rotary unit that is provided coaxially with the driving pulley to rotate integrally therewith, and configured to rotate by receiving a driving force from a driving source, wherein the link and the driving rotary unit overlap with each other in a direction extending from the driving pulley to the driven pulley.

4. The image forming apparatus according to claim 3, comprising:

an outputting rotary unit provided coaxially with the driven pulley to rotate integrally therewith, and configured to output the driving force transmitted to the driven pulley, wherein the link and the outputting rotary unit overlap with each other in the direction extending from the driving pulley to the driven pulley.

5. The image forming apparatus according to claim 4, wherein the outputting rotary unit deviates with respect to the belt to a same side as the driving rotary unit.

6. The image forming apparatus according to claim 1, further comprising:

a frame comprising a first frame portion provided on a first side of the image forming unit and a second frame portion provided on a second side of the image forming unit, the image forming unit being sandwiched between the first and second frame portions, wherein the driving pulley and the driven pulley are mounted to the frame, including at least one of the first frame portion and the second frame portion, and wherein the link is arranged between the frame and the belt.

7. The image forming apparatus according to claim 1, comprising:

a process unit that is detachably attached to the main body through the opening portion to constitute at least part of the image forming unit, and includes an operation body configured to operate by receiving a driving force from the driven pulley, wherein the movable member, which includes a coupling unit configured to intermittently transmit the driving force from the driven pulley to the process unit, is displaced between a position engaged with the process unit and a position spaced apart from the process unit to thereby transmit/interrupt the driving force.

8. The image forming apparatus according to claim 1, wherein the second link portion deviates with respect to the first link portion to a same side as the belt.

9. The image forming apparatus according to claim 1, wherein the first link portion and the second link portion are integrally formed.

10. The image forming apparatus according to claim 1, wherein the belt is a toothed belt having concavities and convexities provided thereon, the concavities and convexities configured to engage with concave and convex portions provided on an outer periphery of the driving pulley and on an outer periphery of the driven pulley.

11. The image forming apparatus according to claim 1, wherein the cover is provided on an upper surface side of the main body.

12. An image forming apparatus provided with an image forming unit configured to form an image on a sheet, the image forming apparatus comprising:

a movable member configured to be displaced relative to a main body of the image forming apparatus;

a cover configured to be displaced between a position where an opening portion provided on the main body is opened and a position where the opening portion is closed;

a link configured to transmit displacement of the cover to the movable member and to displace the movable member in conjunction with the cover;

a driving pulley and a driven pulley, a rotational axis of the driving pulley being arranged parallel to a rotational axis of the driven pulley;

a drive motor configured to transmit a driving force to the driving pulley;

an endless belt looped around and stretched between the driving pulley and the driven pulley and configured to transmit a driving force from the driving pulley to the driven pulley; and a process unit detachably attached to the main body through the opening portion to constitute at least part of the image forming unit, and configured to operate by receiving a driving force from the drive motor via the driving pulley, the belt, and the driven pulley, wherein the belt overlaps with the link in a direction parallel to the rotational axis of the driving pulley.

* * * * *